US005989063A

United States Patent [19]

Daoud

[11] Patent Number: 5,989,063

[45] Date of Patent: Nov. 23, 1999

[54] SPLICE CHAMBER AND CONNECTOR ASSEMBLY FOR A BUILDING ENTRANCE PROTECTOR

[75] Inventor: Bassel Hage Daoud, Parsippany, N.J.

[73] Assignee: Lucent Technologies Inc., Murray Hill, N.J.

[21] Appl. No.: 09/050,510

[22] Filed: Mar. 30, 1998

[51] Int. Cl.[6] ..... H01R 16/60

[52] U.S. Cl. ..... 439/532; 439/709

[58] Field of Search ..... 439/532, 709, 439/710, 711, 712, 713, 714, 715, 716, 717, 718, 719; 174/49, 138 G, 72 A; 361/627, 641, 742, 770, 767, 807–8

[56] References Cited

U.S. PATENT DOCUMENTS

| | | | |
|---|---|---|---|
| 4,712,232 | 12/1987 | Rodgers | 379/329 |
| 4,875,140 | 10/1989 | Delpech et al. | 361/412 |
| 5,595,507 | 1/1997 | Braun et al. | 439/716 |
| 5,741,157 | 4/1998 | O'Conner et al. | 439/532 |
| 5,779,504 | 7/1998 | Dominiak et al. | 439/709 |
| 5,786,989 | 7/1998 | Kawabe | 361/759 |
| 5,816,854 | 10/1998 | Baggett et al. | 439/540.1 |

*Primary Examiner*—Lincoln Donovan
*Attorney, Agent, or Firm*—Gibbons, Del Deo, Dolan, Griffinger & Vecchione

[57] ABSTRACT

A building entrance protector assembly for telecommunication lines. The building entrance protector has a housing in which is disposed a splice chamber. Coaxial apertures are formed on opposing walls of the splice chamber, thereby providing a passage through the splice chamber through which a grouping of wires can pass. A plurality of posts are disposed within the splice chamber. The posts terminate at a predetermined height within the splice chamber that is above the axis of the coaxial apertures. A bracket is provided that is sized to fit within the splice chamber. The bracket is adapted to rest upon the posts. The posts therefore support the bracket above the axis of the coaxial apertures in the splice chamber. A wire connector is supported by the bracket. Accordingly, the posts and bracket act together to support the wire connector above the axis of the coaxial apertures. This ensures that the presence of the wire connector will not interfere with wires passing through the splice chamber between the coaxial apertures.

16 Claims, 4 Drawing Sheets

SPLICE CHAMBER AND CONNECTOR ASSEMBLY FOR A BUILDING ENTRANCE PROTECTOR

RELATED APPLICATIONS

This application is related to the following:

U.S. patent application Ser. No. 09/050,325, entitled INPUT CONNECTOR ASSEMBLY UTILIZING A UNIVERSAL MOUNTING BRACKET, (DAOUD-71) filed Mar. 30, 1998, which is herein incorporated into this disclosure by reference.

BACKGROUND OF THE INVENTION

1. Field of the Invention

The present invention relates to building entrance protectors for telecommunication lines. More particularly, the present invention relates to the connector structure contained within the building entrance protector that connects outside plant wiring to customer premises equipment.

2. Description of the Prior Art

Building entrance protector (BEP) is the name used in the art of telephone equipment to describe the junction box where telephone lines from outside plant wiring are joined to customer premises equipment. In the most common application, the BEP is the place where the telephone lines from a telephone pole enter a building and are joined to the telephone system within that building. Within the BEP there is an input wire termination device that receives the telephone lines contained within the outside plant wiring. Also contained within the BEP is an output wire termination device that receives the telephone lines required for the customer premises equipment. Located in between the input wire termination device and the output wire termination device are fusible links. The fusible links are typically 26 gauge copper wire, which is thinner than the gauge of either the outside plant wiring or the customer premises equipment.

The purpose of the fusible links is to prevent power surges from passing through the BEP that can damage equipment located within the building or melt any wire on the customer side of the BEP. Since telephone lines are typically strung on the same poles as power lines, a break in a power line that subsequently contacts a telephone line, can result in a large surge of power passing through the telephone lines into a building. Similarly, lightning strikes can result large surges of power pass in through telephone lines into a building. The purpose of the BEP is to ensure that any such power surge is stopped at the point of the BEP and is prevented from traveling into the building where it can cause damage to equipment and possibly a fire.

Referring to FIG. 1, a schematic is shown illustrating a common application of BEPs 10 in a building 12. Commonly, a building 12 may have more telephone lines 14 than are capable of being connected to a single BEP 10. Consequently, it is common for a building 12 to utilize a series of BEPs 10. The outside plant wiring 16 enters a building 12 and is directed into a first BEP 10. The first BEP 10 is then used to connect some telephone lines contained within the outside plant wiring 16 to some of the customer premises equipment 18. Any telephone lines contained within the outside plant wiring 16 that are not utilized in the first BEP 10 are passed through the first BEP to a second BEP. Similarly, any telephone lines contained within the outside plant wiring 16 that are not utilized in the second BEP are passed through the second BEP to subsequent BEPs. The number of BEPs 10 used is dependent upon the number of telephone lines supplied by the outside plant wiring 16 and the needs of the customer premises equipment.

Referring to FIG. 2, it can be seen that as the outside plant wiring passes 16 into a BEP 10, the outside plant wiring 16 passes into a sealed, fire-resistant splice chamber 20. Within the splice chamber 20, some of the telephone wires 22 contained within the outside plant wiring 16 are joined to a grouping of fusible links 24. Each set of the fusible links 24 leads to a different surge protector port 26 on a surge protector panel 28. The different surge protector ports 26 are coupled an output wire termination device 30. The customer premises equipment 18 (FIG. 1) connects to the output wire termination device 30, thereby completing the link between the outside plant wiring 16 and the customer premises equipment 18 (FIG. 1).

The fusible links 24 connect to the telephone lines 22 of the outside plant wiring 16 in a number of different ways. Individual wires can be separately joined. However, such connections are highly labor intensive and time consuming. The preferred interconnection mechanism 32 is a terminal array connector 34, such as the model S 66 M connector manufactured by the Siemens Company. With such terminal array connectors 34, the fusible links 24 are connected to the terminal leads on the bottom of the terminal array connector 34 and the telephone wires 22 from the outside plant wiring 16 are connected to the terminal leads on the top of the terminal array connector 34.

All connections between the outside plant wiring 16 and the fusible links 24 are performed within the confines of the splice chamber 20. As a result, any interconnection mechanism 32 used to join the fusible links 24 to the outside plant wiring 16 must also be contained within the splice chamber 20. As a terminal array connector 34 is mounted within the splice chamber 20, there is often an interference between the body of the terminal array connector 34 and the segment of the outside plant wiring 16 that passes through the splice chamber 20 to another BEP. The outside plant wiring 16 that passes through the BEP 10 must be bent around or over the terminal array connector 34. As a result, it is not uncommon for the passing wires of the outside plant wiring 16 to become pinched by the terminal array connector 34 or chafe against the terminal array connector 34. This often causes different telephone lines to either break or short.

Additionally, since the passing wires of the outside plant wiring 16 and the terminal array connector 34 are held at close quarters within the splice chamber 20, when a fusible link 24 does melt, the heat from that melting may also melt some of the passing wires of the outside plant wiring 16. Consequently, a melted fusible link 24 in one BEP may damage a wire that terminates in a different BEP. This makes troubleshooting difficult for repair technicians.

A need therefore exists in the art for a BEP where the interconnection between outside plant wiring and the fusible links can be kept safely away from the wires of the outside plant wiring that pass through that BEP to subsequent BEPs.

SUMMARY OF THE INVENTION

The present invention is a building entrance protector assembly for telecommunication lines. The building entrance protector has a housing in which is disposed a splice chamber. Coaxial apertures are formed on opposing walls of the splice chamber, thereby providing a passage through the splice chamber through which a grouping of wires can pass. A plurality of posts are disposed within the splice chamber. The posts terminate at a predetermined height within the splice chamber that is above the axis of the coaxial apertures.

A bracket is provided that is sized to fit within the splice chamber. The bracket is adapted to rest upon the posts. The posts therefore support the bracket above the axis of the coaxial apertures in the splice chamber. A wire connector is supported by the bracket. Accordingly, the posts and bracket act together to support the wire connector above the axis of the coaxial apertures. This ensures that the presence of the wire connector will not interfere with wires passing through the splice chamber between the coaxial apertures.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
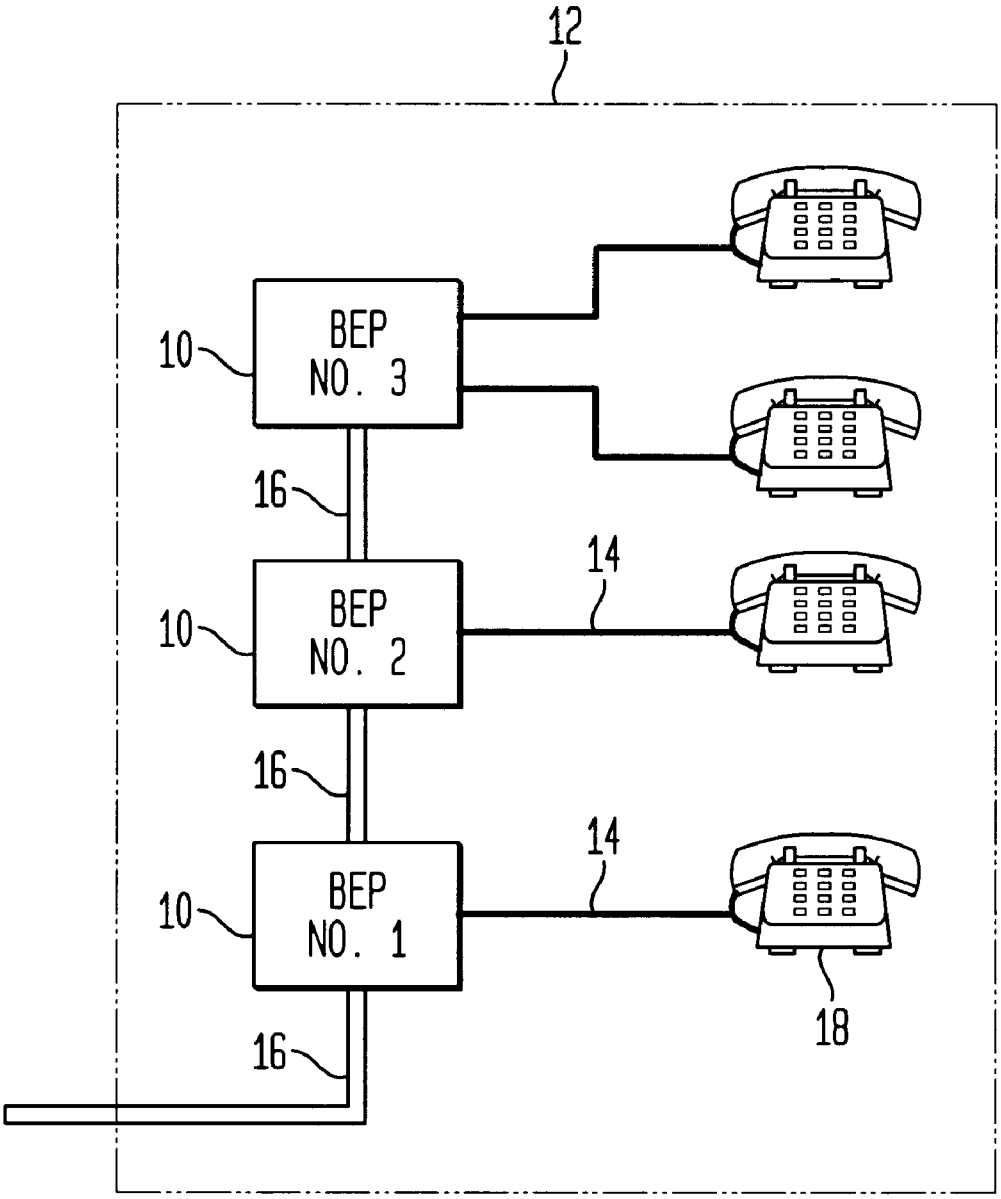
FIG. 1 (PRIOR ART)
FIG. 1 is a schematic view of a prior art application of the use of building entrance protectors for telecommunication lines.
Figure 2:
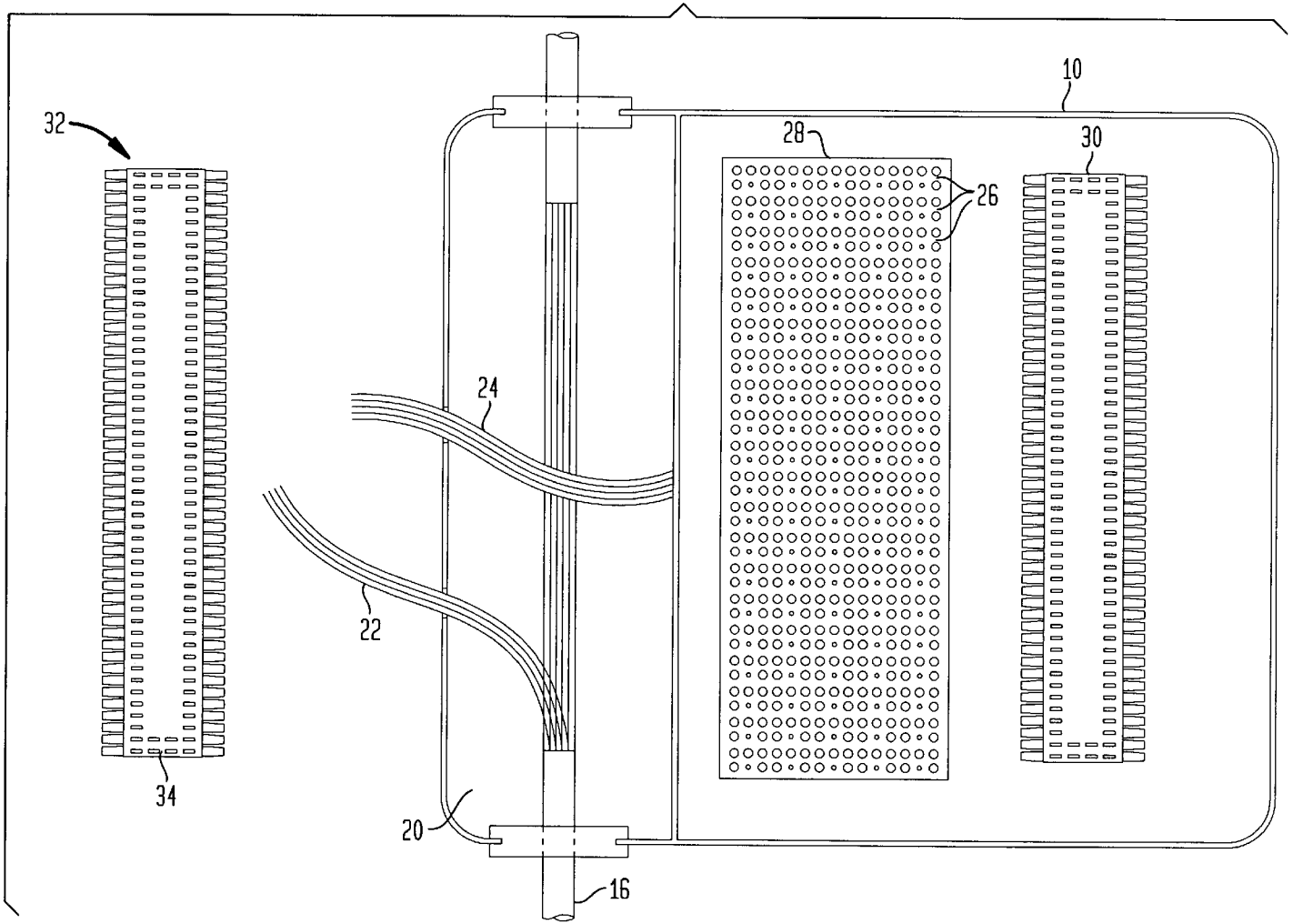
FIG. 2 (PRIOR ART)
FIG. 2 is a front view of a prior art building entrance protector utilizing a terminal array connector.

The present invention improves upon the prior art BEP shown in FIG. 2 and shares many features with the prior art design. For the sake of clarity, elements of the present invention that are the same as the prior art will be referenced using the same reference numerals that were used in describing the prior art.

Figure 3:
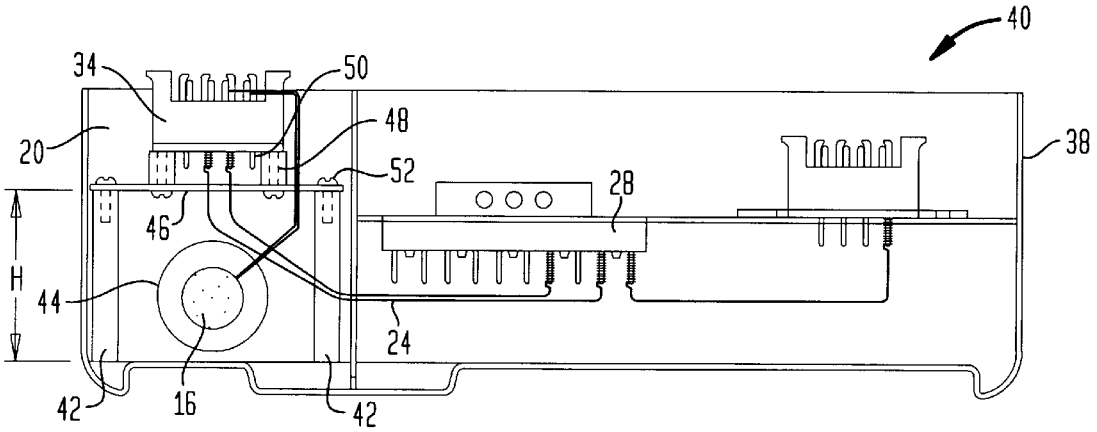
FIG. 3 is a cross-sectional view of a building entrance protector and terminal array connector assembly in accordance with the present invention.

Referring to FIG. 3, it can be seen that a splice chamber 20 is formed within a housing 38 of a BEP 40. At opposite ends of the splice chamber 20 are coaxially aligned apertures 44. The outside plant wiring 16 passing through a particular BEP passes through the aligned apertures 44. Posts 42 are formed within the splice chamber 20 of the BEP 40. These posts 42 can be retroactively added to existing BEPs or can be molded into newly manufactured BEPs. The posts 42 terminate in a common plane a height H above the base of the splice chamber 20. The height H of the posts 42 is higher than the level of the apertures 44 in the BEP 40 through which the unused outside plant wiring 16 passes.

A terminal array connector 34 is mounted to a bracket 46. Dielectric spacers 48 are used to support the bottom terminals 50 of the terminal array connector 34 above the bracket 46. The structure of the bracket 46 and the method of connection between the terminal array connector 34 and the bracket 46 is described in related U.S. patent application Ser. No. 09/050,325, entitled Input Connector Assembly Utilizing A Universal Mounting Bracket, which is assigned to Lucent Technologies the assignee herein and which is incorporated into this disclosure by reference.

As can be seen from FIG. 3, bores are formed in the tops of the posts. The bracket 46 mounts to the top of the posts 42 with screws 52 that engage the bores in the posts 42. The bracket 46, in turn, supports the terminal array connector 34 above the posts 42. The height H of the posts 42 is calculated so that the combined height of the bracket 46 and terminal array connector 34 above the posts 42 will fit within the housing of the BEP 40. Since the posts 42 support both the bracket 46 and the terminal array connector 34 above the height of the outside plant wiring 16, the outside plant wiring 16 is free to pass through the housing of the BEP 40 without deflection or interference. Additionally, the fusible links 24 that connect the terminal array connector 34 to the surge protector board 28 are supported so as to be kept away from the outside plant wiring 16 that passes through the BEP 40. Consequently, should a fusible link 24 melt, it is less likely that the heat of the melting fusible link would affect the outside plant wiring 16 passing through the BEP 40.

Figure 4:
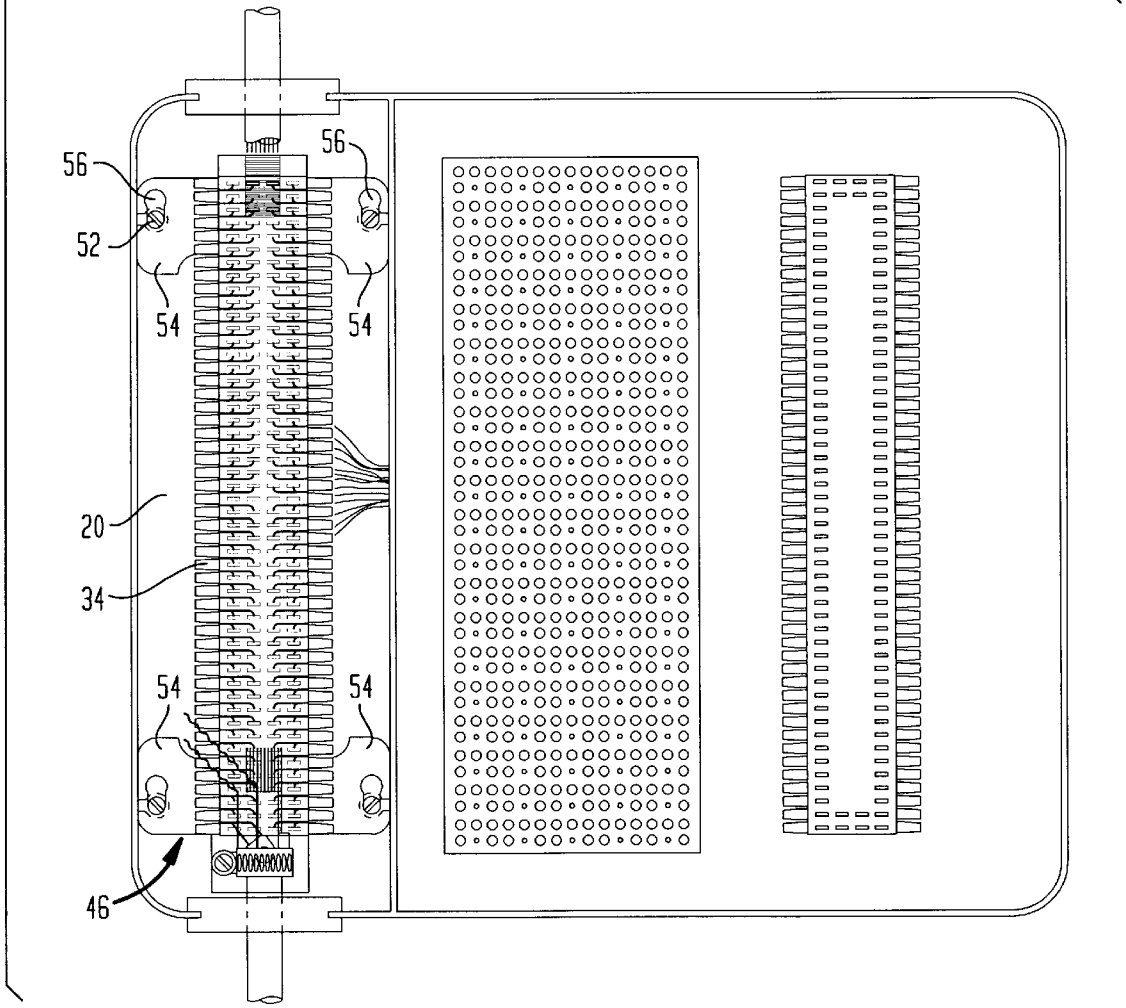
FIG. 4 is a front view of the embodiment of a building entrance protector shown in FIG. 3.

Referring to FIG. 4, it can be seen that the bracket 46 that supports the terminal array connector 34 is generally I-shaped with lateral flanges 54 at its top and bottom. The lateral flanges 54 abut against the interior walls of the splice chamber 20, thereby helping to orient and stabilize the terminal array connector 34 in the splice chamber 20. Furthermore, the lateral flanges 54 rest upon the posts 42 (FIG. 3). Slotted apertures 56 are formed through the lateral flanges 54 at the point where the lateral flanges 54 touch the posts 42 (FIG. 3). The slotted apertures 56 have an enlarged head section and a narrow neck section. The enlarged head section of the slotted apertures 56 is larger than the head of the screw 52 used to attach the bracket 46 to the below-lying posts 42 (FIG. 3). The neck section of the slotted apertures is narrower than the head of that same screw 52. As such, it will be understood that the bracket 46 can be attached to the posts 42 (FIG. 3) by passing the head of the screws 52 through the head section of the slotted aperture 56 and then moving the bracket 46 so that the neck of the slotted aperture 56 passes under the head of the screw 52. Once in this position, the screws 52 can be tightened, thereby locking the bracket 46 into place.

Returning to FIG. 3, it will be understood that when a fusible link 24 does melt, it is desirable to repair the fusible link 24 without replacing the entire BEP. The fusible links 24 normally connect to the bottom of the terminal array connector 34. As such, when repairing the fusible link 24, the old fusible link must be removed from the bottom of the terminal array connector 34 and a new fusible link attached in its place. The presence of the posts 42 and the bracket 46 of the present invention facilitate this operation.

Figure 5:
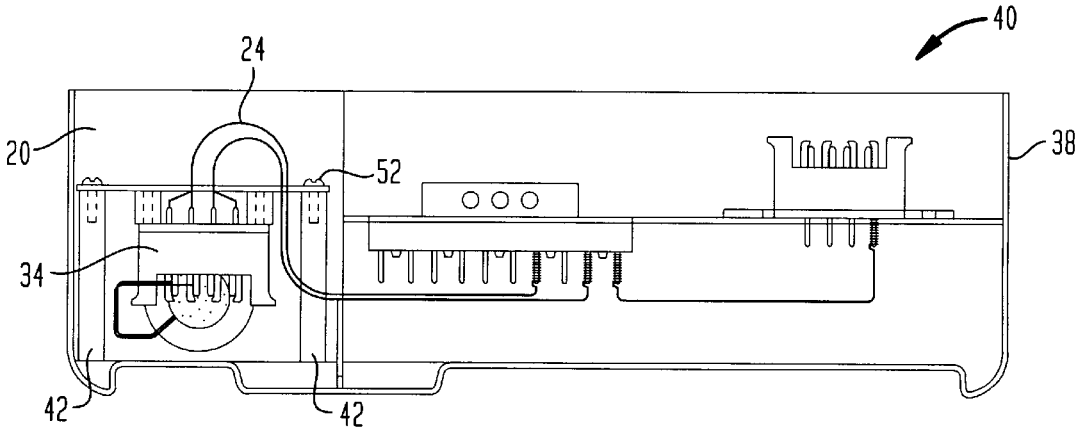
FIG. 5 is an cross-sectional view of the building entrance protector of FIG. 4, shown with an inverted terminal array connector.

Referring to FIG. 5, it can be seen that the terminal array connector 34 can be inverted and again placed upon the posts 42 in the splice chamber 20 of the BEP 40. When in this inverted position, the slotted apertures 56 (FIG. 4) of the bracket 46 still align with the top of the posts 42. Accordingly, the same screws 52 can be used to hold the terminal array connector 34 in the inverted position that were used to hold the terminal array connector 34 in the forward position.

Once supported in the inverted position, the fusible links 24 can be more readily accessed without the need of holding the terminal array connector 34 by hand. This allows a technician to work on the fusible links 2 with both of his/her hands, thereby making for a faster and easier repair.

It will be understood that the embodiments of the present invention specifically shown and described are merely exemplary and that a person skilled in the art can make alternate embodiments using different configurations and functionally equivalent components. For example, the number and location of the posts within the splice chamber can be changed as desired. Furthermore, the shape of the bracket used to support the terminal array connector on the post can also be changed. All such alternate embodiments are intended to be included in the scope of this invention as set forth in the following claims.

What is claimed is:

1. A building entrance protector assembly, comprising:

a terminal array connector having a predetermined width and a predetermined height;

a bracket coupled to said terminal array connector, said bracket being wider than said predetermined width in a plurality of areas, wherein mounting apertures are disposed in said bracket in said areas that extend beyond said predetermined width;

a housing;

a splice chamber disposed within said housing, said splice chamber having opposing walls in which are defined wire apertures that share a common axis;

a plurality of posts disposed within said splice chamber, said posts terminating at a height that is at least as high as said predetermined height, wherein said posts correspond in position to said mounting apertures on said bracket, wherein said bracket is mounted to said posts through said mounting apertures.

2. The assembly according to claim 1, wherein said plurality of posts terminate in a common plane.

3. The assembly according to claim 1, wherein each of said posts has a top surface and a bore is disposed in each top surface that receives a screw.

4. The assembly according to claim 1, wherein said splice chamber has side walls that contact said bracket and guide said bracket onto said posts.

5. The assembly according to claim 1, wherein said posts are integrally formed as part of said splice chamber.

6. The assembly according to claim 1, wherein said posts are spacers that can be removed from said splice chamber.

7. A building entrance protector assembly, comprising:

a housing;

a splice chamber disposed within said housing, said splice chamber having opposing walls in which are defined wire apertures through which a grouping of wires can pass through said splice chamber, wherein said wire apertures have a common central axis;

a plurality of posts disposed within said splice chamber, said posts terminating at a predetermined height within said splice chamber above the axis of said coaxial apertures;

a bracket having a top surface and a bottom surface; and a terminal array connector mounted to said top surface of said bracket; to said bracket, wherein said bracket is mountable to said posts in a forward position, where said bottom surface contacts said posts and said terminal array connector is supported above said posts, and in an inverted position where said top surface contacts said posts and said terminal array connector extends between said posts.

8. The assembly according to claim 7, further including mechanical fasteners for affixing said bracket to said posts.

9. The assembly according to claim 7, wherein said terminal array connector has a height that is less than said predetermined height.

10. The assembly according to claim 7, wherein said plurality of posts terminate in a common plane.

11. The assembly according to claim 7, wherein each of said posts has a top surface and a bore is disposed in each top surface that receives a screw.

12. The assembly according to claim 11, wherein apertures are disposed in said bracket and each one of said apertures align with a bore on one of said posts.

13. The assembly according to claim 7, wherein said posts are integrally formed as part of said splice chamber.

14. The assembly according to claim 7, wherein said posts are spacers that are removable from said splice chamber.

15. In a building entrance protector having a splice chamber and coaxial aperture on opposite walls of said splice chamber through which a grouping of wires pass, a method of mounting a terminal array connector in the splice chamber comprising the steps of:

positioning posts in said spice chamber at positions that do not interfere with said grouping of wires, said posts terminating at points above said grouping of wires; and mounting a terminal array connector to a bracket that is wider than said terminal array connector; and mounting said bracket to said posts, wherein said posts support said terminal array connector above said grouping of wires.

16. The method according to claim 15, wherein said step of positioning posts in said splice chamber is selected from a group consisting of forming posts as part of said splice chamber and adding separate posts to an exiting splice chamber.

* * * * *